United States Patent [19]

Seitz

[11] 4,393,845

[45] Jul. 19, 1983

[54] MEANS FOR IMPROVING THE EFFICIENCY OF AN INTERNAL COMBUSTION ENGINE

[75] Inventor: William R. Seitz, Royal Oak, Mich.

[73] Assignee: The Bendix Corporation, Southfield, Mich.

[21] Appl. No.: 892,722

[22] Filed: Apr. 3, 1978

[51] Int. Cl.[3] ..... F02D 5/02

[52] U.S. Cl. ..... 123/478; 123/352; 123/487

[58] Field of Search ..... 123/32 EA, 32 EB, 32 EC, 123/102, 478, 487, 352

[56] References Cited

U.S. PATENT DOCUMENTS

| | | | |
|---|---|---|---|
| 3,651,460 | 3/1972 | Gebelein, Jr. | 123/102 |
| 3,869,019 | 3/1975 | Cardani | 123/102 |
| 4,047,507 | 9/1977 | Noguchi et al. | 123/32 EA |
| 4,064,846 | 12/1977 | Latsch et al. | 123/32 EA |
| 4,098,242 | 7/1978 | Anderson | 123/102 |

*Primary Examiner*—Charles J. Myhre
*Assistant Examiner*—Andrew M. Dolinar
*Attorney, Agent, or Firm*—Russel C. Wells; Gaylord P. Haas

[57] ABSTRACT

Means for improving the fuel economy and hence efficiency of an internal combustion engine having electronic fuel injection where the amount of fuel delivered to the engine is proportional to the width and frequency of injector pulses. The engine is operated at constant speed and a nominal pulse width is established according to ambient conditions. The pulse width is varied, either increasingly or decreasingly, and the width is measured and stored at one point in time and compared with the width at a later time. If the comparison shows the width at a later time to be narrower than the stored value, variation is continued in the original sense. When the comparison shows that the later value of pulse width is greater than the earlier value, the sense of variation is reversed.

11 Claims, 2 Drawing Figures

MEANS FOR IMPROVING THE EFFICIENCY OF AN INTERNAL COMBUSTION ENGINE

Figure 2:
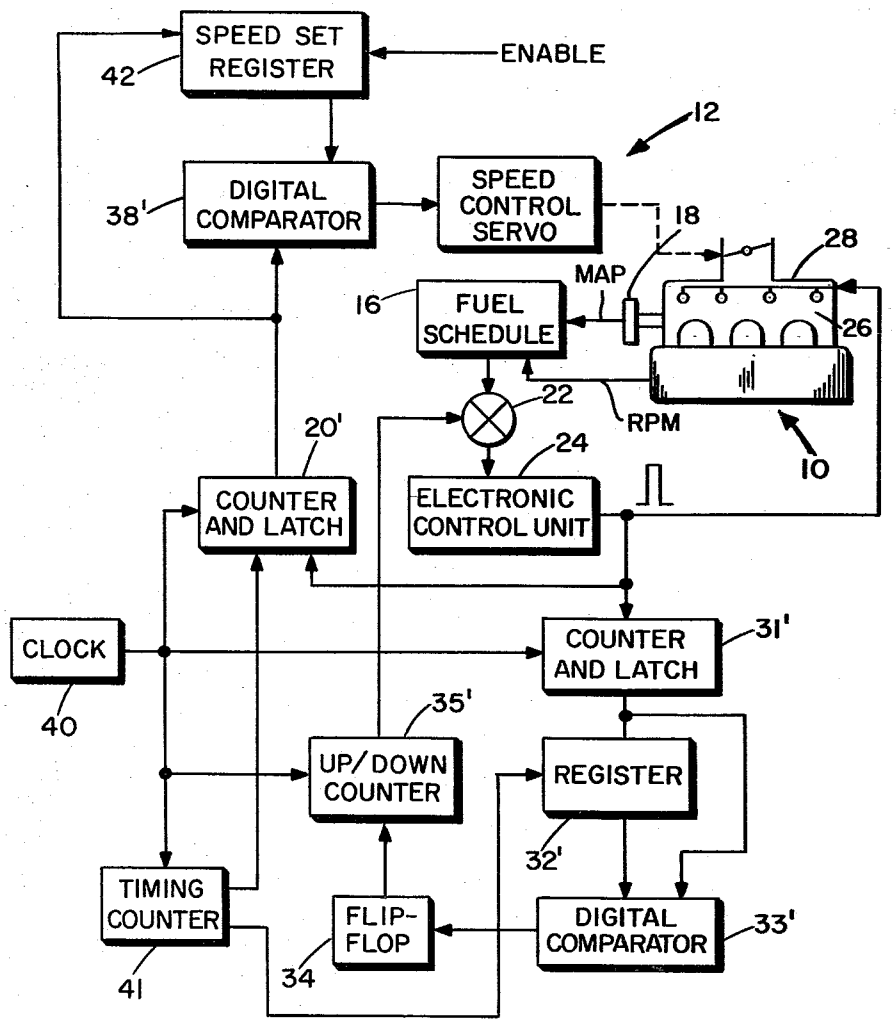

The present invention relates to means for maximizing the efficiency of an internal combustion engine having electronic fuel injection.

In an electronic fuel injection system for an internal combustion engine means are provided for generating a train of electrical pulses of variable width which cause the opening of fuel injector valves for the duration of such pulses. The injectors control the flow of fuel from a constant pressure source to the engine intake manifold. The pulses are synchronized to occur at a definite time during each engine cycle. When the pulses occur at constant frequency, which is equivalent to constant engine speed, the width of the pulses is directly proportional to mass fuel flow. Obviously, when the injector pulse width is reduced to the minimum necessary to maintain constant engine speed, fuel flow will be at a minimum and maximum efficiency will result.

In prior electronic fuel injection systems, as described, for example, in U.S. Pat. No. 3,964,443 "Digital Engine Control System Using DDA Schedule Generators" by T. W. Hartford, injector pulse width is determined by a complex function combining engine speed and manifold absolute pressure. The complex function or fuel schedule is arrived at empirically as that which will yield best performance under a wide range of conditions. However, it is not economical to calibrate individual engines for the optimum fuel schedule. The fuel schedule, therefore, is formulated from tests on a limited number of engines and compromises are included therein to adjust for such variations as are introduced by production tolerances, engine wear, fuel quality, etc. Considering these facts it is clear that there is room for improving the efficiency of even the most carefully designed fuel control system.

It is an object of the present invention to provide means for improving the efficiency of operation of an internal combustion engine.

More particularly, it is an object of the invention to provide self-adaptive means for adjusting fuel flow to an internal combustion engine to the minimum amount required to sustain a constant speed, thereby improving the efficiency of operation of the engine.

Briefly, the invention comprises, in an internal combustion engine equipped with electronic fuel injection and preferably, but not necessarily, automatic speed control, operating the engine at a constant speed and varying by a limited amount the width of the injector pulse supplied by the control unit of the EFI system. The injector pulse width is measured, sampled and stored. The stored value of pulse width is compared with a current value of pulse width to determine the trend of change therein. If the trend is one of decreasing pulse width, the adjustment of pulse width is continued in the sense (increasing or decreasing) existing at the time of the most recent measurement. If the trend is of increasing pulse width the sense of the pulse width adjustment is reversed. The overall effect of such adjustment is to minimize the average pulse width, and thus fuel flow, at any given constant speed with a resultant maximization of efficiency.

Figure 1:
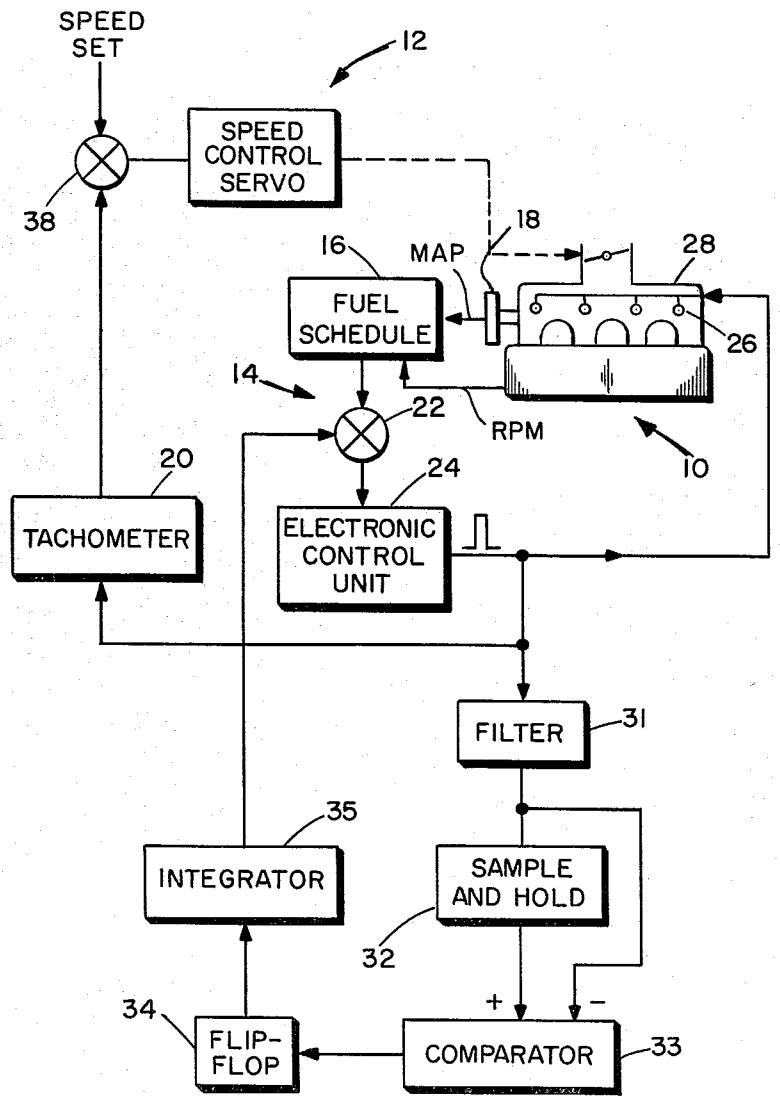

In the drawings:

FIG. 1 is a functional block diagram of the invention utilizing analog circuits for the implentation thereof; and FIG. 2 is a functional block diagram of the invention utilizing digital circuits equivalent to analog circuits of FIG. 1.

In FIG. 1, an internal combustion engine 10 is shown as being equipped with an automatic speed control 12 and an electronic fuel injection system 14. The speed control 12 is shown in simplified form and it may be of the vacuum actuated type shown, for example, in U.S. Pat. No. 3,485,316 or the electromechanical type shown, for example, in U.S. Pat. No. 3,116,807. One simplification made in the speed control of FIG. 1 as compared to those shown in the referenced patents is that in the latter the controlled speed is the vehicle road speed whereas in FIG. 1 the controlled speed is the engine speed. Under highway cruise conditions, however, the vehicle speed and the engine speed bear a substantially constant relationship to one another so that the referenced speed controls and the simplified control will perform in the same manner.

The electronic fuel injection system 14 is also shown in a simplified form as compared to the earlier referenced system of U.S. Pat. No. 3,964,443. As shown herein, system 14 comprises fuel scheduling means 16 receiving inputs from a manifold pressure sensor 18 and an engine speed sensor, tachometer 20, from which a basic pulse width command signal is formulated and applied through summary junction 22 to an electronic control unit 24. Control unit 24 generates a train of pulses 25 of controlled width which energize injector valves 26 interposed between a constant pressure fuel source (not shown) and the engine intake manifold 28. It is to be understood that the electronic fuel injection system 14 would, in practice, include other elements not shown here for purposes of simplicity, such as temperature and air density sensors and means for synchronizing control unit 24 with the engine.

Injector pulses 25 from control unit 24 are applied to a low pass filter 31, the output of which comprises the average value of the pulses, directly proportional to the pulse width. The output of filter 31 is periodically sampled, suitably at intervals of 1–10 seconds, by a sample and hold circuit 32, of conventional design, which retains at its output the voltage level of the output of filter 31 present at the moment of sampling. The output of sample and hold circuit 32 is compared with the instantaneous value of the output of filter 31 in a comparator circuit 33, of conventional design, which produces an output of one sense, say positive, if the output from sample and hold circuit 32 is greater than the instantaneous output of filter and which produces an output of the opposite sense, negative, if the converse is true of the magnitudes of the inputs thereto.

The output of comparator 33 is connected to a flip-flop 34 so as to trigger the flip-flop into changing state only if the output of the comparator becomes negative. Flip-flop 34 provides a constant level two-state output, i.e. of opposite polarities, which, when integrated in an integrator 35 produces a triangular-like waveform increasing or decreasing in value depending upon the polarity of the flip-flop output. The output of integrator 35 is added to the pulse width control voltage from fuel schedule means 16 in summing junction 22. The gain of integrator 35 is adjusted so as to provide an output amplitude of the order of $\pm 10\%$ of the amplitude of the control voltage from fuel schedule means 16.

In operation, assuming the invention to be installed in an automobile, the operator would accelerate the automobile to a desired cruising speed and actuate the speed control whereupon the output of tachometer 20 prevailing at that moment would be memorized and retained as a reference against which the tachometer output is continuously compared. The memorized value of engine speed is shown as the speed set input to a summing junction 38. The output of junction 38, which is the difference between the desired speed and the actual speed causes servo 12 to adjust the engine throttle in a direction to reduce the output of junction 38 to zero. As the throttle position and engine load varies, so will the manifold pressure vary, causing the fuel schedule means to provide at junction 22 a particular pulse width control voltage. Assuming at this time that the control voltage from 16 is of such value as to cause the pulse width to be wider than necessary to maintain the desired speed and that the output of integrator 35 is of such sense as to reduce the pulse width. Then the output of the sample and hold circuit will be of greater magnitude than the instantaneous magnitude of the filter output. The comparator will not trigger the flip-flop into changing state and the output of the integrator will continue to change in a direction causing the injector pulses to be narrowed.

However, after a time, the injector pulses will be narrowed to the point where the engine combustion mixture is too lean to sustain the desired engine speed. The speed control servo will open the engine throttle wider causing an increase in manifold pressure and an increase in the pulse width control voltage from the fuel schedule means. Then the instantaneous magnitude of the filter output will be greater than the output of the sample and hold circuit causing the comparator to trigger the flip-flop into changing state and reversing the slope of the output of the integrator. The output from the integrator tends further to increase the injector pulse width to the point where the engine speed becomes greater than the desired speed. Then the speed control servo reduces the throttle opening, causing the fuel schedule means to narrow the pulse width and because the magnitude of the integrator output is of the order of $\pm 10\%$ the magnitude of the pulse width control voltage from the fuel schedule means, the latter dominates and the overall result is a trend toward reducing the pulse width. When the throttle closure reaches the point at which the engine speed drops below the desired speed, the speed control servo reverses to commence opening the throttle and widening the pulse width. The comparator detects the trend towards increasing pulse width and triggers the flip-flop into changing state, reversing the slope of the integrator output. Under steady state conditions, therefore, the injector pulse width will undergo an oscillation between a moderately rich and a moderately lean fuel delivery with the average value thereof being that which delivers maximum economy of operation.

FIG. 2 illustrates the system of FIG. 1 wherein the analog circuits there described are replaced by their digital equivalents. A clock oscillator 40, suitably operating at a frequency of 5 kHz, supplies clock pulses to a counter and latch circuit 20', which counts during the interval between successive leading edges of a pair of injector pulses for control unit 24. A timing counter 41 determines the frequency at which the interval between injector pulses is measured, say once per second. The number latched in counter and latch 20' is inversely proportional to engine speed and upon the appearance of a speed set enabling signal at speed set register 42, the then existent number held by latch 20' is memorized and retained as the reference. Subsequent instantaneous values of the speed related numbers contained by counter and latch 20' and compared against the reference contained in register 42 in digital comparator 38'; replacing summing junction 38. The difference between the reference speed number and the instantaneous speed number at the output of comparator 38' serves as an error signal for servo 12, analogously to the output of summing junction 38.

A second counter and latch circuit 31' commences count of clock pulses upon the appearance of the leading edge of an injector pulse from control unit 24 and stops count at the trailing edge of that injector pulse. The count, which is directly proportional to pulse width, is latched and retained until the appearance of the next injector pulse.

Periodically, at intervals corresponding to the sample period of sample and hold circuit 32 of FIG. 1, timing counter 41 causes transfer of the then existent number retained in 31' to a register 32'. Register 32' retains the transferred number during the period between signals from timing counter 41 until the appearance of the next transfer signal from counter 41 whereupon the register is up-dated to the new then existent number in latch 31'.

A digital comparator 33' continuously compares the number stored in register 32' with the numbers appearing from latch 31' and triggers flip-flop 34 into changing state whenever the number from latch 31' exceeds the number contained by register 32', analogously to the operation of comparator 33 of FIG. 1.

Flip-flop 34 controls the direction of count of an up-down counter 35' which continuously counts clock pulses. Up-down counter 35' includes a digital-to-analog converter if the pulse width control from fuel schedule means is an analog voltage. If the fuel schedule means provides pulse width control in digital form, the output of up-down counter 35' would be utilized in digital form and summing junction 22 would be replaced by a digital adder circuit.

Digital comparator 33', flip-flop 34 and up-down counter 35 operate in a manner equivalent to comparator 33, flip-flop 34 and integrator 35 to cause the injector pulse width to be widened or narrowed, changing the sense of such variation whenever comparator 33' detects that the number in latch 31' is greater than the number in register 32'.

Although the invention has been disclosed in combination with an automatic speed control, it may be used with manual speed control but such an application would require constant attention by the operator to maintain a desired speed. The combination with automatic speed control is therefore to be preferred.

The invention claimed is:

1. In an internal combustion engine having means for controlling the speed thereof and having an electronic fuel injection system which meters fuel to the engine in proportion to the width of pulses applied to engine fuel injectors, said fuel injection system establishing the width of said fuel injector pulses as a function of ambient engine operating parameters, wherein the improvement comprises:

means for increasing the efficiency of operation of said engine including;

means for varying in either a positive or negative sense the width of said fuel injector pulses established by said fuel injection system;

means for maintaining the speed of said engine constant;

means providing a quantity proportional to the width of said injector pulses;

means for periodically sampling and storing said quantity;

means for comparing an instantaneous value of said quantity with said stored value of said quantity to determine which of said compared values is of greater magnitude; and means for reversing the sense of pulse width variation produced by said pulse width varying means whenever said comparing means indicates that the sense of change in said pulse width is in the direction of increased fuel consumption by said engine.

2. In an internal combustion engine having means for controlling the speed thereof and having an electronic fuel injection system which meters fuel to the engine in proportion to the width of pulses applied to engine fuel injectors, said fuel injection system establishing the width of said fuel injector pulses as a function of ambient engine operating parameters, wherein the improvement comprises:

means for increasing the efficiency of operation of said engine including;

means for varying in either a positive or negative sense the width of said fuel injector pulses established by said fuel injection system;

means for maintaining the speed of said engine constant;

means providing digital clock pulses;

a digital counter and latch circuit;

means controlling said counter and latch so as to enable count therein of said clock pulses upon the appearance of a leading edge of said injector pulse and to latch the count of said clock pulses at the value accumulated upon the appearance of the trailing edge following said leading edge of said injector pulse;

a digital register;

means periodically transferring the count latched in said counter and latch circuit to said register;

means for comparing a current count latched in said counter and latch circuit with the count in said register to determine which of said compared counts is of greater magnitude; and means for reversing the sense of pulse width variation produced by said pulse width varying means whenever said comparing means indicates that the sense of change in said pulse width is in the direction of increased fuel consumption by said engine.

3. The combination of claim 2 wherein said means for varying the width of said fuel injector pulses includes, an up-down counter for counting said clock pulses;

means for reversing the direction of count by said up-down counter whenever said comparing means determines that the magnitude of said current compared count exceeds the magnitude of said transferred compared count; and means utilizing the output of said up-down counter to alter the width of injector pulses established by said fuel injection system.

4. In an internal combustion engine having a throttle for controlling the flow of intake air to the engine and an electronic fuel injection system which meters fuel to the engine in proportion to the time duration of pulses applied to engine fuel injectors, said fuel injection system establishing the time duration of said fuel injection pulses as a function of ambient engine operating parameters wherein the improvement comprises means for increasing the efficiency of operation of said engine including:

means for determining the frequency of said fuel injector pulses to provide a signal proportional to actual engine speed;

means providing a reference signal proportional to a desired engine speed;

means comparing said actual engine speed signal with said reference signal to provide an error signal;

means controlled by said error signal for adjusting said engine throttle in such manner as to tend to reduce said error signal to zero;

means for varying in either an increasing sense or a decreasing sense the time duration established by said fuel injection system for said fuel injector pulses;

means for determining the actual time duration of said fuel injector pulses resulting from the combined effects of said throttle adjusting means, said fuel injection system and said varying means;

means for determining the sense of the change in the actual time duration of said fuel injector pulses; and means for reversing the sense of variation of said varying means whenever the sense of change in the actual time duration of said fuel injector pulses is in the direction of increasing actual time duration.

5. In an internal combustion engine having means for controlling the speed thereof and having an electronic fuel injecction system which meters fuel to the engine in proportion to the width of pulses applied to engine fuel injectors, said fuel injection system establishing the width of said fuel injector pulses as a function of ambient engine operating parameters and providing a control voltage for establishing the width of said injector pulses, wherein the improvement comprises means for increasing the efficiency of operation of said engine including:

means for varying in either a positive or negative sense the width of said fuel injector pulses established by said fuel injection system wherein said means for varying the width of said fuel injector pulses comprises, an integrator providing a voltage output proportional to the time integral of a voltage input thereto from said means for determining the sense of change in the width of said injector pulses, and means for adding the output of said integrator to said fuel injecctor system control voltage;

means for maintaining the speed of said engine constant;

means for determining the sense of the change in the width of said injector pulses over a period of time wherein said means for determining the sense of change in the width of said injector pulses comprises, means providing a quantity proportional to the width of said injector pulses, means for periodically sampling and storing said quantity, and means for comparing an instantaneous value of said quantity with said stored value of said quantity to determine which of said compared values is of greater magnitude; and means for reversing the sense of pulse width variation produced by said pulse width varying means whenever said determining means indicates that the sense of change in said pulse width is in the direction of increased fuel consumption by said engine.

6. The combination claimed in claim 5 wherein said means for reversing the sense of pulse width variation comprises a flip-flop having two states of output, said states being constituted by two different voltage levels;

means providing the output of said flip-flop as the input to said integrator, and means connecting the output of said comparing means to said flip-flop to trigger said flip-flop from one output state to the other output state whenever said comparing means determines that the magnitude of said instantaneous value is greater than the magnitude of said stored value.

7. In an internal combustion engine having a throttle for controlling the flow of intake air to the engine and an electronic fuel injection system which meters fuel to the engine in proportion to the time duration of pulses applied to engine fuel injectors, said fuel injection system establishing the time duration of said fuel injection pulses as a function of ambient engine operating parameters wherein the improvement comprises means for increasing the efficiency of operation of said engine including:

means for determining the frequency of said fuel injector pulses to provide a signal proportional to actual engine speed wherein said means for determining the frequency of said fuel injector pulses includes, a source of clock pulses and a counter and latch circuit for counting said clock pulses during the interval between a pair of said fuel injector pulses and for temporarily retaining the result of said count;

means providing a reference signal proportional to a desired engine speed;

means comparing said actual engine speed signal with said reference signal to provide an error signal;

means controlled by said error signal for adjusting said engine throttle in such manner as to tend to reduce said error signal to zero;

means for varying in either an increasing sense or a decreasing sense the time duration established by said fuel injection system for said fuel injector pulses;

means for determining the actual time duration of said fuel injector pulses resulting from the combined effects of said throttle adjusting means, said fuel injection system and said varying means;

means for determining the sense of the change in the actual time duration of said fuel injector pulses; and means for reversing the sense of variation of said varying means whenever the sense of change in the actual time duration of said fuel injector pulses is in the direction of increasing actual time duration.

8. The combination claimed in claim 7 wherein said means for determining the actual time duration of said fuel injector pulses includes, a second counter and latch circuit for counting said clock pulses for the duration of one of said fuel injector pulses and for temporarily retaining the result of count by said second counter.

9. The combination as claimed in claim 8 wherein said means for determining the sense of the change in the actual time duration of said fuel injector pulses includes, a register;

means for periodically transferring said result latched in said second counter and latched to said register; and a comparator for comparing a current result latched in said second counter and latch with a result previously transferred to said register to determine which of said compared results is of the greater magnitude.

10. The combination as claimed in claim 9 wherein said means for varying the time duration established by said fuel injection system for said fuel injector pulses includes, an up-down counter for counting said clock pulses, said up-down counter having control means for selecting whether said clock pulses are applied as increments to increase a number contained by said up-down counter or as decrements to decrease a number contained by said up-down counter; and means for altering in proportion to the number contained by said up-down counter the time duration established by said fuel injection system for said fuel injector pulses.

11. The combination as claimed in claim 10 wherein said means for reversing the sense of said varying means comprises, means for applying the output of said comparator to the control of said up-down counter to cause the direction of count by said up-down counter to be reversed whenever the magnitude of said compared current result is greater than the magnitude of said compared transferred result.

* * * * *